US005279049A

United States Patent [19]

Skaugen et al.

[11] Patent Number: 5,279,049

[45] Date of Patent: Jan. 18, 1994

[54] PROCESS FOR THE RESTRAINED DRYING OF A PAPER WEB

[75] Inventors: Borgeir Skaugen; Gregory L. Wedel, both of Beloit, Wis.

[73] Assignee: Beloit Technologies, Inc., Wilmington, Del.

[21] Appl. No.: 530,386

[22] Filed: May 30, 1990

Related U.S. Application Data

[63] Continuation of Ser. No. 201,705, Jun. 2, 1988, abandoned, which is a continuation-in-part of Ser. No. 14,569, Feb. 13, 1987, Pat. No. 4,934,067.

[51] Int. Cl.[5] ..... F26B 3/08

[52] U.S. Cl. ..... 34/115; 34/117

[58] Field of Search ..... 34/114, 115, 116, 117, 34/120; 162/202, 204, 207

[56] References Cited

U.S. PATENT DOCUMENTS

| | | | |
|---|---|---|---|
| 2,537,129 | 1/1951 | Goodwillie | 92/49 |
| 2,714,342 | 8/1955 | Beachler | 92/53 |
| 2,959,222 | 11/1960 | Hornbostel | 162/360 |
| 3,079,699 | 3/1963 | Fry, Jr. | 34/13 |
| 3,110,612 | 11/1963 | Gottwald et al. | 117/64 |
| 3,263,344 | 8/1966 | Stickle | 34/116 |
| 3,395,073 | 7/1968 | Davis, Sr. | 162/369 |
| 3,868,780 | 3/1975 | Soininen et al. | 34/116 |
| 4,000,035 | 12/1976 | Schiel et al. | 162/290 |
| 4,183,148 | 1/1980 | Koski et al. | 34/23 |
| 4,202,113 | 5/1980 | Kankaanpaa | 34/23 |
| 4,359,827 | 11/1982 | Thomas | 34/16 |
| 4,359,828 | 11/1982 | Thomas | 34/114 |
| 4,441,263 | 4/1984 | Vedenpää | 34/115 |
| 4,481,723 | 11/1984 | Vedenpää | 34/114 |
| 4,483,083 | 11/1984 | Chance | 34/113 |
| 4,510,698 | 4/1985 | Ely | 34/117 |
| 4,539,762 | 9/1985 | Eskelinen et al. | 34/114 |
| 4,566,944 | 1/1986 | Mauranen et al. | 162/286 |
| 4,608,124 | 8/1986 | Mauranen et al. | 162/193 |
| 4,625,430 | 12/1986 | Aula et al. | 34/13 |
| 4,625,434 | 12/1986 | Karlsson et al. | 34/114 |
| 4,677,762 | 7/1987 | Futcher | 34/114 |
| 4,686,778 | 8/1987 | Kotitschke et al. | 34/117 |
| 4,986,009 | 1/1991 | Haessner et al. | 34/23 |
| 5,062,216 | 11/1991 | Hannigan | 34/16 |

FOREIGN PATENT DOCUMENTS

| | | |
|---|---|---|
| 2355397 | 6/1974 | Fed. Rep. of Germany . |
| 2813933 | 10/1978 | Fed. Rep. of Germany . |
| 3520070 | 12/1985 | Fed. Rep. of Germany . |
| 9001209 | 5/1990 | Fed. Rep. of Germany . |
| 63-89996 | 6/1988 | Japan . |
| 2173832 | 10/1986 | United Kingdom . |
| 8202937 | 9/1982 | World Int. Prop. O. . |
| 8300514 | 2/1983 | World Int. Prop. O. . |
| 8804206 | 6/1988 | World Int. Prop. O. . |

OTHER PUBLICATIONS

*Advances in Dryer Section Runnability;* by G. L. Wedel & S. Palazzolo; TAPPI Journal; Sep. 1987, pp. 65-69.

"Examining Runnability in the Dryer Section"; by I. Binns; Paper; Jul. 1987; pp, 27-28.

"Neue Elemente Bei Der Papiertrocknung"; by J. Fischer; Jun. 1989.

"No. 16 Takes Shape", *Consolidated News,* vol. 29, No. 4, Aug.-Oct. 1991; pp. 8-10.

*Primary Examiner*—Henry A. Bennet

*Attorney, Agent, or Firm*—Dirk J. Veneman; Raymond W. Campbell; David J. Archer

[57] ABSTRACT

A process is disclosed for the restrained drying of a paper web in a dryer section of a paper machine. The process includes the steps of wrapping the web with a felt during passage of the web with the felt around a dryer of the dryer section and thereafter wrapping the web around a portion of a guiding device disposed immediately downstream relative to the dryer so that edge curl of the web is minimized.

3 Claims, 7 Drawing Sheets

Effect of Sheet Vacuum Restraint on Sheet Shrinkage

Sheet Elongation Profiles

Sheet Tensile Strength Profiles

Sheet Tensile Ratio Profile

Effect of Sheet Vacuum Restraint on Sheet Shrinkage

Effect of Sheet Vacuum Restraint on Sample Tensile Strength

Effect of Sheet Vacuum Restraint on Sample TEA

Single - Felt Dryer Section

Beloit BelRun Single-Tier Dryer Section

Sample Shrinkage Characteristics

Effect of Restraint on Hygroexpansivity (2)

PROCESS FOR THE RESTRAINED DRYING OF A PAPER WEB

CROSS-REFERENCE TO RELATED APPLICATIONS:

This is a continuation of copending application Ser. No. 07/201,705 filed on Jun. 2, 1988 abandoned, which is a continuation in part of co-pending U.S. Ser. No. 014,569 filed Feb. 13, 1987. All the disclosure of copending Ser. No. 014,569 is incorporated herein by reference.

BACKGROUND OF THE INVENTION

1. Field of the Invention

The present invention relates to a process for the restrained drying of a paper web in a dryer section of a paper machine. More particularly, the present invention relatives to a process which includes restraining the web against cross-machine direction shrinkage so that edge curl of the web is inhibited.

2. Information Disclosure Statement

In the manufacture of a paper web, when a web has been formed, it is thereafter pressed in a press section to remove a substantial portion of the moisture therefrom. The web is then guided through a dryer section in order to remove a further portion of moisture from the web so that the resultant web will attain the required sheet characteristics.

A typical dryer section includes a plurality of dryers arranged as a first and a second tier with the first tier disposed above the lower tier. The web is threaded around alternate upper and lower dryers in serpentine configuration so that alternate sides of the web are sequentially exposed to the external surfaces of the dryers.

In the aforementioned arrangement, the upper tier of dryers is wrapped by an upper dryer felt and the lower tier of dryers is wrapped by a lower dryer felt. The arrangement is such that the upper and lower felts restrain the web against cross-machine direction shrinkage during passage of the web around the respective upper and lower dryers. However, a problem exists in that with the aforementioned arrangement, the web is unsupported by either the upper or the lower felt during transit of the web between the upper and lower dryers. Such unrestrained movement of the web permits cross-machine direction shrinkage with the attendant resultant edge curl.

In an attempt to reduce edge curl and cockle in the resultant web, dryer sections have been installed in which a single dryer felt extends contiguously with the web around respective upper and lower dryers so that no open draw or unsupported passage of the web between dryers is permitted. While the aforementioned single felted or Uno-run dryer sections assist in supporting the web during transit between upper and lower dryers such single felted arrangements suffer from at least the following disadvantages. First, the felt is disposed between the web and the lower dryer thereby rendering the lower dryers redundant. Second, the web is disposed on the outside of the felt during passage around the lower dryers so that there exists a tendency for the web to flutter relative to the felt during passage around the lower dryers. Such fluttering of the web means that the web is unrestrained during passage around the lower dryer drum.

Ideally, the web should be restrained against cross-machine direction shrinkage during the entire passage of the web through the dryer section. Such ideal situation is achieved by the employment of the TOTAL BEL RUN arrangement proposed in copending patent application Ser. No. 014,569 filed Feb. 13, 1987 and assigned to Beloit Corporation.

In Ser. No. 014,569 there is disclosed a single tier dryer section in which the web and felt disposed contiguously relative to each other are guided alternately around dryers and vacuum guide rolls. The guide rolls replace the lower redundant dryer drums of the aforementioned single felt arrangements. The vacuum guide rolls draw the web towards the guide roll during passage of the web around the guide roll such that the web is pressed against the felt during passage around the vacuum guide roll thereby restraining the web against cross-machine direction shrinkage.

Therefore, cross-machine direction shrinkage is not only inhibited during passage of the web around the dryer but also around the vacuum guide roll. Furthermore, the vacuum guide roll being of a diameter considerably less than that of the dryer results in a joint run of the web and felt between the dryers and the guide rolls which is minimal so that the web is restrained against cross-machine direction shrinkage throughout most of the passage through the dryer section.

The aforementioned sheet restraint reduces edge curl and cockle and the graininess of the resultant sheet at the edges thereof. Furthermore, by the provision of such sheet restraint, the slice opening in the headbox is able to be more uniform and the cross direction fiber orientation profile is improved.

More specifically, various laboratory and mill studies have been carried out in order to quantify the nonuniform cross directional sheet shrinkage which occurs during conventional drying processes. The aforementioned nonuniform shrinkage is responsible for nonuniformities in headbox slice profiles, in fiber orientation, and in the sheet elongation and tensile energy absorption.

Tensile energy absorption hereinafter referred to as TEA is defined in "The Dictionary of Paper" Fourth Edition, published 1980, as the energy absorbed when a paper specimen is stressed to rupture under tension. It is expressed in energy units per unit area e.g. kg-cm/cm$^2$. It is useful in evaluating packaging materials subject to rough handling.

The continuous drying restraint which is applied by a total no-draw dryer section as exemplified in the TOTAL BEL RUN concept of Beloit Corporation, has a direct effect on the finished sheet properties by controlling the cross-directional elongation and TEA profiles. Additionally, such reduced shrinkage reduces the cockles and graininess of the sheet edges.

The aforementioned dictionary defines cockles as "a puckered condition of the sheet resulting from nonuniform drying and shrinking; it usually appears on paper that has had very little restraint during drying."

Furthermore, graininess is defined in the aforementioned dictionary as small variations in the surface appearance of a paper or board, resulting from any of a variety of causes, such as impressions of wires or felts, irregular distribution of color, and uneven shrinkage in drying.

Also, by restraining the sheet from cross direction shrinkage, the opening of the slice lip of the headbox may be maintained more uniform and an improved cross direction fiber orientation profile is obtained as stated more particularly hereinafter.

The aforementioned TOTAL BEL RUN includes the transfer of the web between dryers with positive support and restraining the sheet with fabric pressure and roll vacuum. The combination of the aforementioned arrangement has improved sheet threading, machine runability, and sheet properties.

In a conventional dryer section, the wet paper is dried by intermittent contact with cast-iron, steam heated dryers. The thermal contact between the paper and the dryer is maintained by tensioned dryer fabrics which apply a pressure to the paper as it wraps the dryer. Typical fabric tensions range from 8 to 12 pounds per linear inch (PLI) which depending on the dryer diameter, will apply a fabric pressure which is in the range of 0.25 to 0.35 PSI which is 6 to 10 inches water gauge (WG).

The aforementioned fabric pressure not only improves the drying contact, but also applies a restraint to the paper to prevent shrinkage from occurring. Such restraint, however, is repeatedly released as the sheet passes through the open draws between conventional dryer cylinders as described hereinbefore.

The fabric pressure continues to provide some restraint in the machine direction by maintaining a machine direction draw, but in the cross-machine direction, the paper is virtually unrestrained. The paper shrinks freely in the cross direction particularly at the edges and somewhat less so near the center of the web where the sheet is at least partly restrained by the outer portions.

Such nonuniform cross-machine shrinkage gives rise to nonuniform cross-directional sheet properties such as stretch, TEA and tensile.

Stretch is defined in the aforementioned dictionary as "the elongation corresponding to the point of rupture in a tensile strength measurement; it is usually expressed as a percentage of the original length."

The high cross-directional edge shrinkage also aggravates the susceptibility of the sheet to edge cockle, curl and graininess.

The aforementioned dictionary defines curl as "the curvature developed when one side of a paper specimen is wetted; it was formally used as a measure of the degree of sizing."

The lack of shrinkage restraint also increases the hygroexpansivity and can also have an adverse effect on fiber orientation. Hygroexpansivity is defined in "The Dictionary of Paper" as "the change in dimension of paper that results from a change in the ambient relative humidity; it is commonly expressed as a percentage and is usually several times higher for the cross direction than for the machine direction. This property is of great importance in applications where the dimensions of paper sheets and cards or construction board (wallboard, acoustical tile, etc.) are critical."

In various mill trials, the first phase of such study was directed at quantifying the nonuniformity on commercial paper machines and then determining the effect that the nonuniform shrinkage has on the machine operation and on the finished sheet properties.

The cross-directional sheet shrinkage was determined by metering fine drops of ink onto the stock as it discharged from the slice lip of the headbox. The distances between marks at the wet end were then compared to the distances at the dry end to determine the cross-directional shrinkage profile.

Results for a fine paper machine are discussed hereinafter. The shrinkage was found to be highly nonuniform, and in fact almost parabolic. As expected, the highest shrinkage was found to occur at the edges, where the sheet has the least cross-directional restraint and the sheet shrinkage was the lowest near the center where the paper was at least partly restrained by the outer portions.

A cross-directional paper sample was then tested in the laboratory to determine the variations in sheet properties and these results are discussed in greater detail hereinafter. Such results show the machine direction stretch is very uniform in the cross direction because it is controlled by the machine direction draws. However, the cross-directional stretch is very nonuniform which appears to be a direct reflection of the cross-directional shrinkage. In other words, the highest stretch occurs at the edges where the sheet has experienced the greatest shrinkage.

The machine direction and cross direction tensile strength profiles were also measured for the same sample.

Tensile strength is defined in the aforementioned dictionary as "the maximum tensile stress developed in a specimen before rupture under prescribed conditions; it is usually expressed as force per unit width of the specimen."

As discussed hereinafter the machine direction tensile was fairly uniform, again being affected in part by the machine direction draw which does not vary in the cross direction. However, the cross direction tensile profile is nonuniform and exhibits a slight hyperbolic configuration. The lowest tensile occurs near the sheet edges, again where the cross-direction shrinkage was the greatest.

From the aforementioned tests, it is also evident that an increase in cross-direction restraint, as experienced near the center of the machine, causes a reduction in stretch with a corresponding increase in tensile strength. Since the cross-direction tensile varies in the cross direction, while the machine direction tensile remains fairly uniform, the tensile ratio also varies, with the highest ratio occurring at the edges.

The tensile ratio is the ratio of the tensile in the cross direction to the tensile in the machine direction and will be discussed in detail hereinafter.

The TEA profiles were also measured for the sample. The cross-direction profile reflected the nonuniformity in cross-direction stretch. The TEA profile, however, does not exhibit quite as much variation as the CD stretch, because the loss in stretch near the machine center is greatly offset by the increase in tensile strength.

The increased shrinkage which occurs near the edges also has an adverse effect on headbox performance. In order to produce a level basis weight profile at the reel, the slice opening must be closed down near the edges. Such closing down near the edges of the slice opening reduces the basis weight at the edges to compensate for the higher shrinkage which occurs near the edges. Such reduction in basis weight causes the paper to go through the press section and earlier dryer sections with light edges which eventually heavy up as the edges shrink.

Basis weight is defined in the aforementioned dictionary as "the weight in pounds of a ream cut to a specified basis size. The number of sheets in a ream is usually 500."

The aforementioned nonuniform slice opening is known to cause a distortion of the fiber orientation by inducing cross flows.

The fiber orientation was determined for the aforementioned sample by measuring the sonic modulus profile as discussed hereinafter. The fiber orientation is indicated as the angle of the primary axis of the modulus envelope from the machine direction. A positive angle indicates the fibers are oriented towards the back side of the web and a negative angle indicates the fibers are oriented towards the front side.

The fibers are all oriented towards machine center line as would be expected because the slice opening is closed down near the edges to compensate for edge shrinkage.

The aforementioned advantages obtained by restrained drying of the web are reflected in considerable commercial advantages over webs produced in nonrestrained drying sections.

In order to achieve a level weight profile with a uniform slice opening, it is necessary to control the cross-direction shrinkage. Since this shrinkage occurs as the moisture is removed, the majority of the shrinkage takes place in the open draws where water flashes. In order to reduce the shrinkage, the open draws must be replaced by means of positive restraint.

A common commercial arrangement for eliminating open draws is the single felt or serpentine dryer section. Although such serpentine arrangement does eliminate the open draws, it does not replace the open draws with positive restraint and it dries the sheet from one side only.

The aforementioned TOTAL BEL RUN, however, replaces the bottom ineffective dryers of the serpentine section with vacuum rolls. Two-sided drying is maintained in this arrangement by alternating between top-felted and bottom-felted single tier sections as described in the aforementioned pending patent application Ser. No. 014,569.

The intermediate vacuum roll of the aforementioned single tier section acts much like the fabric vacuum box used in laboratory studies discussed in detail hereinafter. The vacuum maintains the restraint which is applied by the dryer fabric pressure as the sheet is transferred between dryers.

The vacuum induced in conventional serpentine blow boxes is typically only 0.1 to 0.2 inches water column (WC) and this is clearly inadequate to provide significant shrinkage restraint. Additionally, such low level vacuum does not extend around the entire bottom dryer. With the longer sheet length between top dryers, the sheet is left unrestrained for a significant portion of the drying cycle in the conventional serpentine or single felt dryer section.

A vacuum level of 6 to 8 inches water column in the vacuum rolls is essentially equal to the restraint which is applied by the dryer fabric. Such vacuum level is also the level which is required for positive sheet restraint as discussed hereinafter.

The sheet restraint used in the various laboratory studies was applied continuously and in order to achieve the same property improvements on a commercial machine, the drying restraint was also applied continuously or at least in those sections where the sheet is shrinking the most. Very specific laboratory tests were carried out on pilot machine samples in order to determine the natural or unrestrained shrinkage characteristics.

For the furnish used, the machine direction and cross-direction shrinkage is very low as the sheet is dried from 40 to 60 percent dry. Once the sheet reaches 60 percent dry, the shrinkage increases and continues at a high rate until the sheet is essentially dry.

The serpentine and in some cases single-tier dryer sections had been used at the wet end of the dryer section. Such application had been carried out to improve runability. However, in view of the aforementioned increased shrinkage above 60 percent dry, it became evident that the single-tier dryer section should be applied near the dry end of the machine for improved paper properties and for the best runability and sheet quality, the single-tier dryer section configuration should be applied to the entire dryer section as taught in the aforementioned pending patent application Ser. No. 014,569.

Therefore it is a primary object of the present invention to provide a process that overcomes the aforementioned inadequacies of the prior art drying methods and to provide a process which makes a considerable contribution to the art of paper drying.

Another object of the present invention is the provision of a process for restrained drying of a paper web in a dryer section which includes the steps of wrapping the web with a felt during passage of the web with the felt around the dryer of the dryer section and thereafter wrapping the web around a portion of a guiding device disposed immediately downstream relative to the dryer so the edge curl of the web is minimized.

Another object of the present invention is the provision of a process which includes restraining the web against cross-machine direction shrinkage during passage of the web past the guiding device so that edge curl of the web is inhibited.

Another object of the present invention is the provision of a process for the restrained drying of a paper web which reduces cockle and graininess of the sheet edges.

Another object of the present invention is the provision of a process which allows the slice opening to be more uniform thereby improving the cross-direction fiber orientation profile.

Other objects and advantages of the present invention will be evident from the detailed description contained hereinafter taken in conjunction with the various figures of the drawings and graphs and from the disclosure of the appended claims.

SUMMARY OF THE INVENTION

This invention relates to a process for the restrained drying of a paper web. The process includes the steps of wrapping the web with a felt during passage of the web with a felt around the dryer of the dryer section and thereafter wrapping the web around a portion of a guiding device disposed immediately downstream relative to the dryer so the edge curl of the web is minimized.

More particularly, the process includes the steps of restraining the web against cross-machine direction shrinkage during passage of the web around a portion of the external surface of a rotatably cylindrical dryer, passing the web from the dryer to a web guiding device disposed closely adjacent to and immediately downstream relative to the dryer, wrapping the web around a part of the external face of the guiding device and restraining the web against cross-machine direction shrinkage during passage of the web past the guiding device so the edge curl of the web is inhibited.

In a specific process the step of restraining the web during passage around the external surface includes wrapping the web with a felt such that the web is sandwiched between the felt and the external surface so that the felt restrains the web against cross-machine direction shrinkage.

Also, the step of passing the web from the dryer to the web guiding device includes passing a joint run of the web and felt from the dryer to the web guiding device such that the web is disposed between the felt and the dryer.

Additionally, the step of wrapping the web around part of the external face of the guiding device includes wrapping the web and felt disposed contiguously relative to the web around part of the external face of the guiding device such that the felt is sandwiched between the web and the part of the external face of the guiding device.

The process also includes in the step of wrapping the web and felt around part of the external face of the guiding device, rotating the guiding device by frictional contact with the felt.

The step of restraining the web during passage past the guiding device also includes sandwiching the felt between the web and the external face of the guiding device which is a rotatable guide roll so that the web is restrained against cross-machine direction shrinkage during passage of the web around the rotatable guide roll.

The step of restraining the web during passage past the guide roll includes directing a flow of air in a direction from the web towards the guide roll such that the web is pressed into close conformity with the felt during passage of the web and felt past the guide roll so that the web is restrained against cross-machine direction shrinkage.

The present invention is not limited by the various process steps described in the detailed description but rather is defined by the appended claims. Many variations and modifications of the process steps described hereinafter may be made by those skilled in the art without departing from the spirit and scope of the present invention as defined by the appended claims.

BRIEF DESCRIPTION OF THE DRAWINGS

Similar reference characters refer to similar parts throughout the various embodiments shown in the drawings.

DETAILED DESCRIPTION OF THE DRAWINGS

Figure 1:
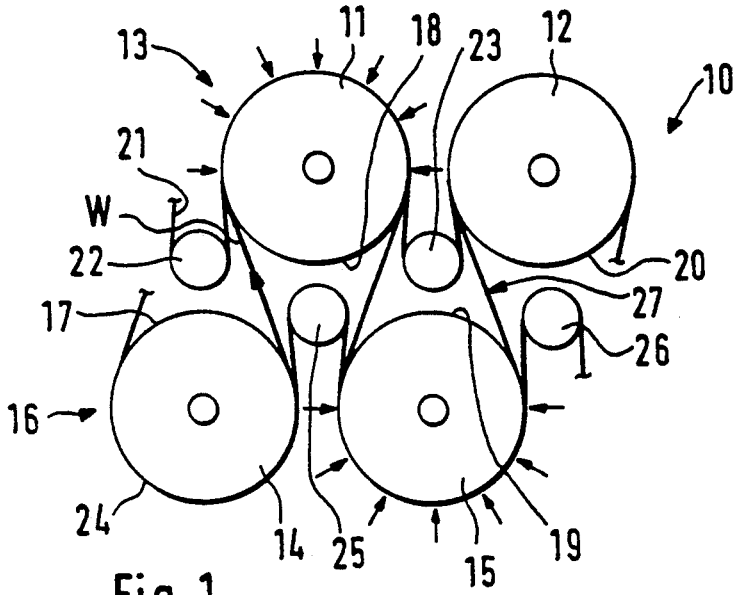
FIG. 1 is a side-elevational view of a typical prior art double-felted dryer section.

FIG. 1 is a side-elevational view of a typical double-felted dryer section generally designated 10 including dryers 11 and 12 of an upper tier generally designated 13. The dryer section 10 also includes lower dryers 14 and 15 of a lower tier generally designated 16. The web W extends in sinusoidal configuration past dryers 14, 11, 15 and 12 respectively so that alternate sides of the web are dried as they come into contact with the respective external surfaces 17, 18, 19 and 20 of dryers 14, 11, 15 and 12. An upper felt 21 extends around a guide roll 22 and then around dryer 11. The upper felt 21 then extends around a further guide 23 and the upper dryer 12. Similarly, a lower felt 24 after extending around dryer 14 extends around a lower guide roll 25 and dryer 15 and then around a further lower guide roll 26.

Although this prior art dryer section provides sheet restraint during passage around the respective upper and lower dryers 11, 12, 14 and 15, the web is unsupported and therefor unrestrained against shrinkage during transit of the web W between for example dryers 14 and 11. Such unsupported web is known in the art as an open draw 27. Because the web W is unsupported during transit through the open draws 27, cross-machine direction shrinkage of the web occurs with the attendant edge curl, graininess, and edge cockles.

Figure 2:
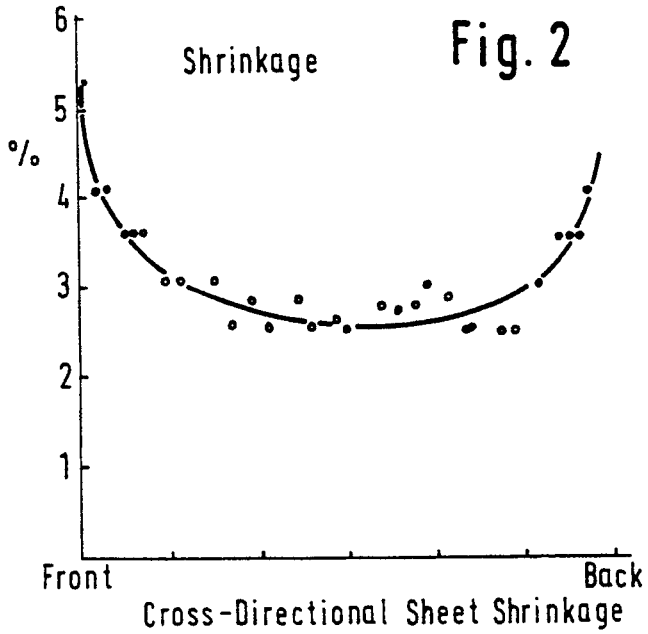
FIG. 2 is a graph showing the percentage of shrinkage from the front to the back edge of the sheet.

FIG. 2 is a graph showing the results for a fine paper machine wherein the shrinkage was found to be highly nonuniform with the graph being almost parabolic. As expected, the highest shrinkage was found to occur at the edges where the sheet has the least cross-directional restraint and the sheet shrinkage was the lowest near the center where the paper was at least partly restrained by the outer portion. In the graph of FIG. 2, the x axis includes readings taken from the front edge to the back edge of the sample web and the amount of shrinkage is shown as a percentage of the initial width.

Figure 3:
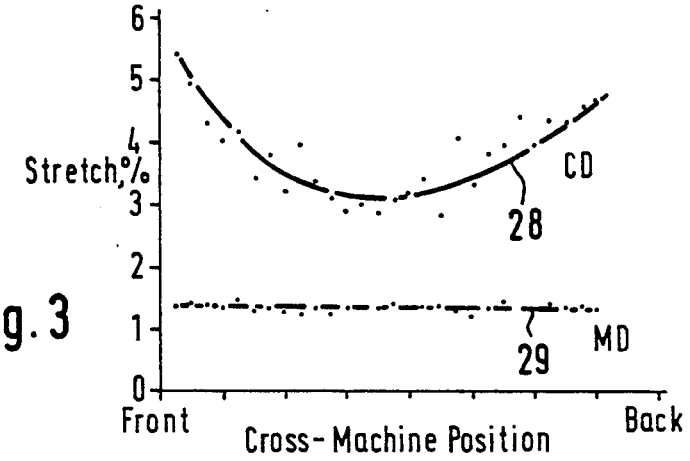
FIG. 3 is a graph comparing sheet elongation profiles in a machine direction and a cross-machine direction.

FIG. 3 is a graph showing a cross-directional paper sample tested in the laboratory to determine the variations in sheet properties. As shown in FIG. 3, the machine direction and cross-machine direction sheet strength profiles are demonstrated. The machine direction stretch is very uniform in the cross direction because it is controlled by the machine direction draws. However, the cross-machine direction stretch is very nonuniform as shown by the graph. From a comparison of the graph 28 with the graph 29 of the machine direction, it appears there is a direct reflection of the cross-direction shrinkage, that is the highest stretch occurs at the edges where the sheet has experienced the greatest shrinkage.

Figure 4:
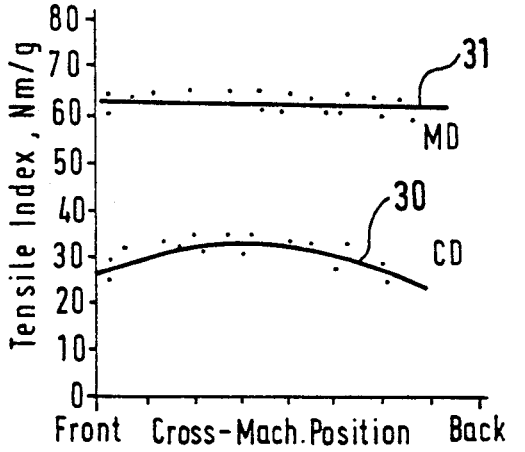
FIG. 4 is a graph comparing the sheet tensile strength profiles in a machine direction and cross-machine direction.

The graph shown in FIG. 4 includes a graph of the sheet tensile strength profiles for the cross-machine direction 30 and the graph for the machine direction 31. The machine direction tensile as shown in FIG. 4 is fairly uniform again being affected in part by the machine direction draw which does not vary in the cross-direction. The cross-direction tensile profile, however, is nonuniform. It exhibits a slight "frown" or hyperbolic shape. The lowest tensile occurs near the sheet edges again where the cross-machine direction shrinkage was the greatest.

Figure 5:
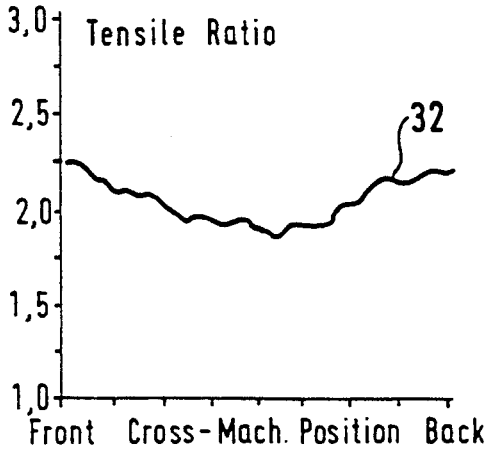
FIG. 5 is a graph showing the sheet tensile ratio profile from the front to the back edge of the sheet.

From the above data it is clearly demonstrated that an increase in cross-machine direction restraint, as experienced near the center of the machine causes a reduction in stretch with a corresponding increase in tensile strength. Since the cross-machine direction tensile varies in the cross direction, while machine direction tensile remains fairly uniform, the tensile ratio also varies with the highest ratio occurring at the edges as shown by the tensile ratio graph 32 shown in FIG. 5.

Figure 6:
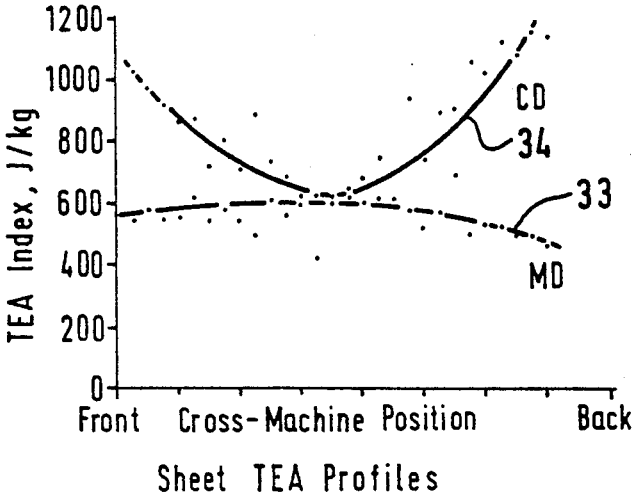
FIG. 6 is a graph showing the sheet tensile energy absorption profiles from the front to the back edge of the sheet for the machine direction and the cross-machine direction respectively.

FIG. 6 shows two graphs 33 and 34. Graph 33 demonstrates the sheet TEA profile in a machine direction where graph 34 shows the sheet TEA profile for the cross-machine direction.

The TEA profiles also measured for the same sample. The cross-machine direction profile shown in FIG. 6 reflects the nonuniformity in the cross-machine direction stretch. The TEA profile, however, does not exhibit quite as much variation as the cross-machine direction stretch because the loss in stretch near the machine center is partly offset by the increase in the tensile strength.

The increased shrinkage which occurs near the edges can also have an adverse effect on the headbox performance. In order to produce a level basis weight profile at the reel, the slice opening must be closed down near the edges such reduction of the basis weight at the edges to compensate for the higher shrinkage which occurs near the edges. This causes the paper to go through the press section and early dryer section with light edges which eventually heavy up as the edges shrink.

Figure 7:
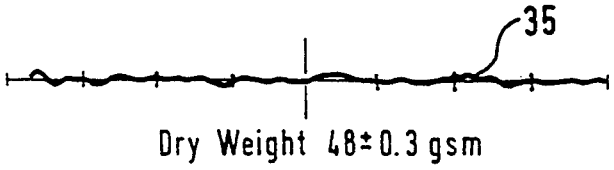
FIG. 7 is a graph showing the dry weight of a sheet from the front to the back edge thereof.

FIG. 7 is a graph 35 showing the dry weight of a sample sheet from the front to the back edge thereof.

Figure 8:
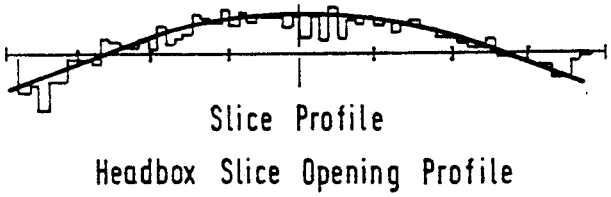
FIG. 8 shows a slice profile of a headbox with the opening profile configured such that a dry weight is obtained as shown in FIG. 7.

FIG. 8 is a graph showing the slice profile required in order to obtain the result shown in FIG. 7. As shown in FIG. 8 the slice openings are reduced at the respective edges in order to obtain a relatively uniform resultant web after shrinkage.

The fiber orientation was determined for the sample by measuring the sonic modulus profile. The profile is shown in FIG. 8 which is a graph from the front to the back of the sheet. The graph indicates actual readings whereas the graph 36 shows the average orientation. The fiber orientation is indicated as the angle of the primary axis of the modulus envelope from the machine direction. A positive angle indicates that the fibers are oriented towards the back side, and a negative angle indicates that the fibers are oriented towards the front side.

In the sample used, the fibers were all oriented towards the machine center line, as expected, because the slice opening was closed down near the edges to compensate for edge shrinkage.

EXAMPLES

Numerous hand sheet trials in the laboratory were performed which indicated that increased sheet restraint during drying produces a reduction in stretch, an increase in tensile strength, and an increase in modulus.

In the trial, instead of using hand sheets, the samples were manufactured on pilot twin-wire machines at commercial speeds. These sheets were then freely dried on a dryer fabric which was supported by a vacuum box. Separate sheets were dried with different levels of vacuum in the box to provide different levels of sheet shrinkage restraint.

Figure 9:
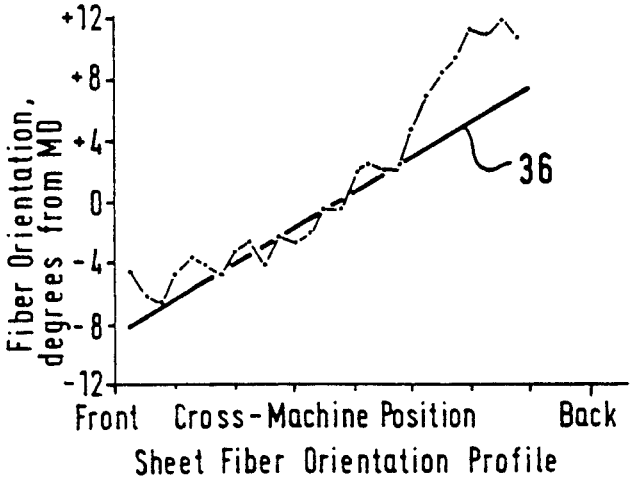
FIG. 9 is a graph showing sheet fiber orientation profile from the front to the back edge of the sheet.

With no vacuum in the box, the machine made sheet was able to shrink unrestrained. The total machine direction shrinkage was about 1% and the total cross-machine direction shrinkage was nearly 7%, as shown in FIG. 9. However, as the vacuum level (drying restraint) was increased, there was a progressive decrease in shrinkage.

The corresponding sheet properties for these samples are shown in FIGS. 10 to 13 for stretch, tensile, modulus and TEA. The same trends are seen in these properties as indicated by the mill trials. The increased cross-machine direction restraint (experienced by the center samples of the commercial machine and induced by the vacuum box in the laboratory studies) caused similar changes in the finished sheet properties.

Figure 10:
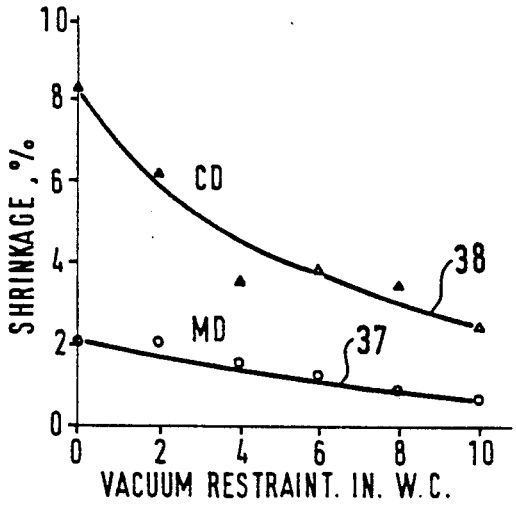
FIG. 10 is a graph comparing machine direction to cross-machine direction shrinkage and the effects thereon of sheet vacuum restraint on such sheet shrinkage.

More specifically, FIG. 10 shows the effect of sheet vacuum restraint on sheet shrinkage for machine direction as shown by graph 37 and for cross-machine direction as shown by graph 38.

Figure 11:
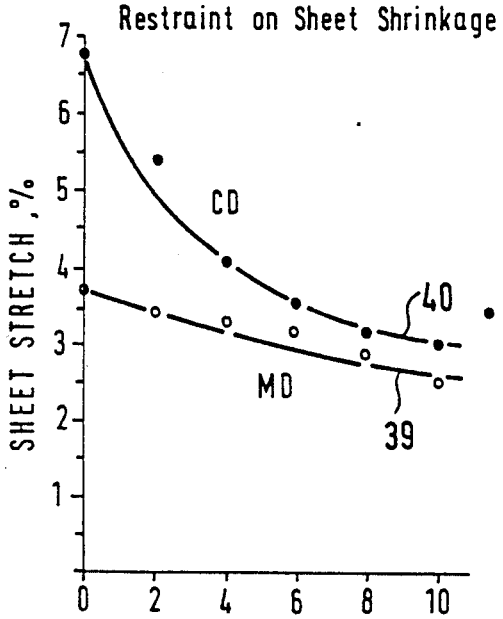
FIG. 11 is a graph similar to that shown in FIG. 9 but showing the effect of sheet vacuum restraint on sample stretch.

FIG. 11 shows the effect of sheet vacuum restraint on sample stretch and shows graph 39 for the machine direction and graph 40 for the cross-machine direction.

Figure 12:
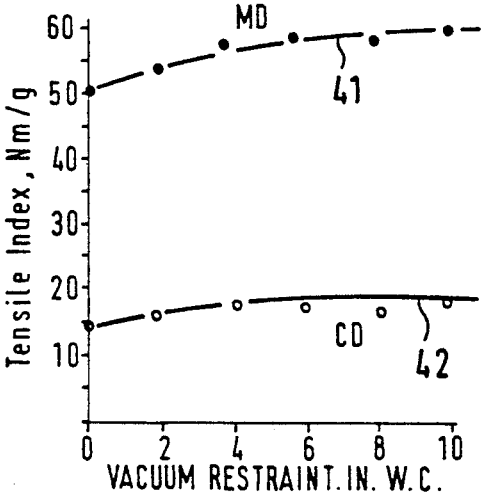
FIG. 12 is a graph showing the effect of sheet vacuum restraint on sample tensile strength.

FIG. 12 shows the effect of sheet vacuum restraint on sample tensile strength with the machine direction graph 41 and the cross-machine direction 42.

Figure 13:
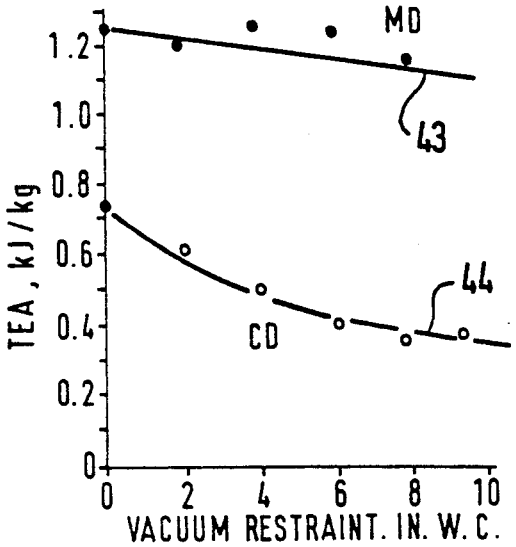
FIG. 13 is a graph showing the effect of sheet vacuum restraint on sample TEA.

FIG. 13 shows the effect of sheet vacuum restraint on sample TEA with graph 43 indicating machine direction and graph 44 showing cross-machine direction.

In order to achieve a level weight profile without a nonuniform slice opening, and in order to produce a sheet with uniform cross-direction property profiles, it is necessary to control the cross-machine direction shrinkage. Since the shrinkage occurs as the moisture is removed, the majority of the shrinkage takes place in the open draws where the water flashes. In order to reduce the shrinkage, the open draws must be replaced by a means of positive restraint as exemplified in co-pending patent application Ser. No. 014,569.

Figure 14:
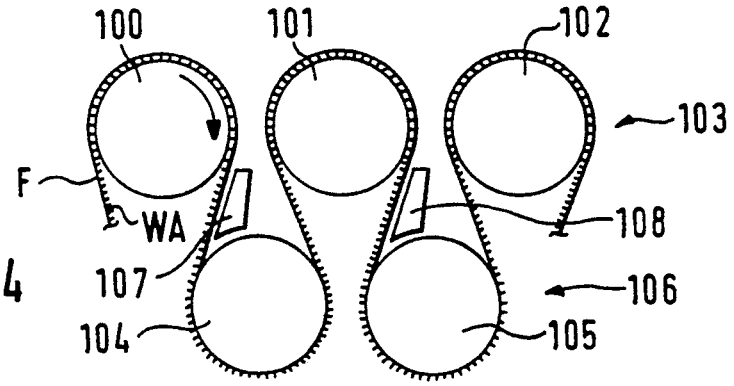
FIG. 14 is a side-elevational view of a single felt dryer section or serpentine run or UNO-run dryer section.

A common commercial arrangement for eliminating open draws is the single felt or serpentine dryer section shown in FIG. 14.

In FIG. 14 dryers 100, 101 and 102 constitute a upper tier generally designated 103 whereas dryers 104 and 105 constitute a lower tier 106. A joint run of the web WA and felt F extends in serpentine configuration respectively around the dryers 100, 104, 101, 105 and 102.

Although blow boxes 107 and 108 draw the web towards the felt during transit of the web between dryers, such vacuum is insufficient to cause any appreciable restraint of the web. Although this arrangement does eliminate the open draws, it does not replace the open draws with positive restraint and it dries the sheet from one side only.

Figure 15:
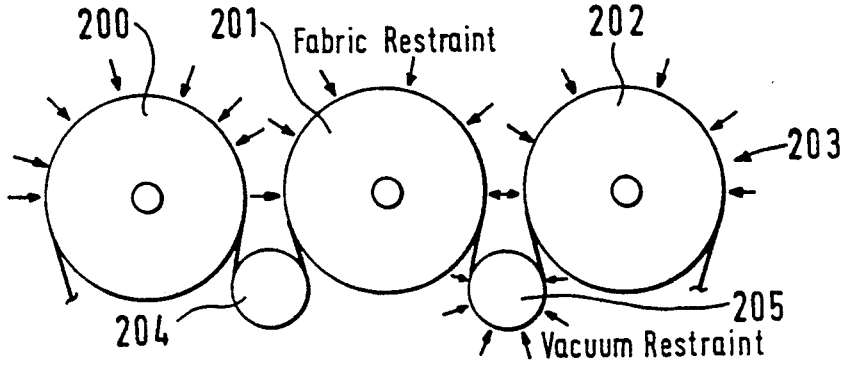
FIG. 15 is a side-elevational view of a TOTAL BEL RUN single tier dryer section as described in copending patent application Ser. No. 014,569.

FIG. 15 shows the TOTAL BEL RUN arrangement disclosed in copending patent application Ser. No. 014,569 including dryers 200, 201 and 202 arranged as a single tier generally designated 203. Interposed between the dryers 200 and 201 is a vacuum guide roll 204. Furthermore, another guide roll 205 is disposed between the dryers 201 and 202. In this design the bottom ineffective dryers of the serpentine section shown in FIG. 14 have been eliminated and replaced with vacuum rolls 204 and 205. Two-sided drying is maintained in this arrangement by alternating between top-felted and bottom-felted single tier sections as shown in copending application Ser. No. 014,569.

The intermediate vacuum rolls 204 and 205 of the aforementioned single tier section 203 act much like the fabric vacuum box used in the aforementioned laboratory studies. This vacuum maintains the restraint which is applied by the dryer fabric pressure as the sheet is transferred between dryers.

The vacuum which is induced by conventional serpentine blow boxes is typically only 0.1 to 0.2 inches water column and is clearly inadequate to provide significant shrinkage restraint as shown from FIG. 9. Additionally, this low level vacuum does not extend around the entire bottom dryer. With the long sheet length between top dryers, the sheet is left unrestrained for a significant portion of the drying cycle in the conventional serpentine dryer section.

A vacuum level of 6 to 8 inches WC in the vacuum rolls is essentially equal to the restraint which is applied to the dried fabric. It is also the vacuum level which is required for positive sheet restrain as indicated in FIG. 9.

The sheet restraint used in the above laboratory studies was applied continuously. In order to achieve the same property improvements on a commercial machine, the drying restraint must also be applied continuously, or at least in those sections where the sheet is shrinking the most. Specific laboratory tests were made on the pilot machine samples to determine the natural or unrestrained shrinkage characteristics. The results for one of these samples is shown in FIG. 16.

Figure 16:
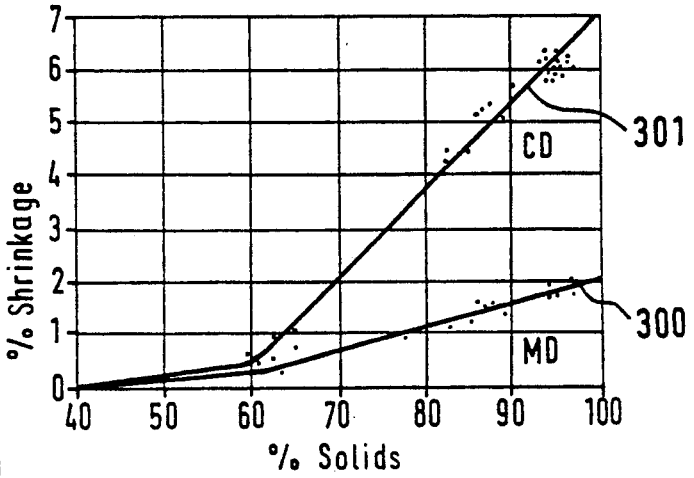
FIG. 16 is a graph showing sample shrinkage characteristics in a machine direction and in a cross-machine direction respectively.

In FIG. 16 for the particular furnish, the machine direction and cross-machine direction shrinkage as indicated by graphs 300 and 301 respectively, shrinkage is very low as the sheet is dried from 40 to 60 percent dry. Once the sheet reaches 60% dry, the shrinkage increases and continues at a high rate until the sheet is essentially dry.

The serpentine and single tier dryer without vacuum guide rolls have been applied to the wet end of the dryer section. This has been done in order to improve runability. However, based on the results of FIG. 16, the single tier dryer section should be applied near the dry end of the machine. For improved paper properties for best runability and sheet quality, the single tier dryer section configuration should be applied to the entire dryer section.

Figure 17:
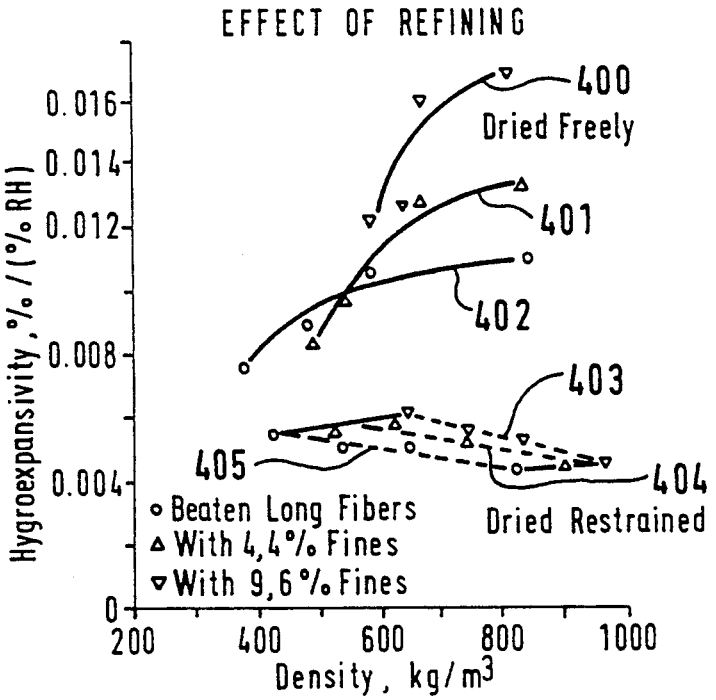
FIG. 17 is a graph showing the effect of restrained compared to nonrestrained on hygroexpansivity.

In addition to the aforementioned improvements in sheet quality resulting from sheet restraint during drying, recent work has indicated that sheets dried under restraint exhibit a significant reduction in hygroexpansivity. These results shown in FIG. 17, show that the sheet is more stable when it is dried under restraint and also that the sheet hygroexpansivity is virtually unaffected by changes in sheet density, that is from pressing and fines content as a result of the fining.

A sheet which is dried under a restraint is significantly different from one which is dried freely.

The reduction in shrinkage also reduces the susceptibility of the sheet to develop curl, cockle, and grainy edges. These sheet defects are all induced by hygroexpansivity and aggravated by nonuniformities in Z direction by the density, filler distribution, fines distribution, and fiber orientation. By reducing the hygroexpansivity, these defects can be greatly reduced or eliminated. FIG. 17 shows the effect of restraint on hygroexpansivity, the upper graphs 400, 401 and 402 representing freely dried sheets and the graphs 403, 404 and 405 representing sheets dried under restraint.

Figures 18, 19:
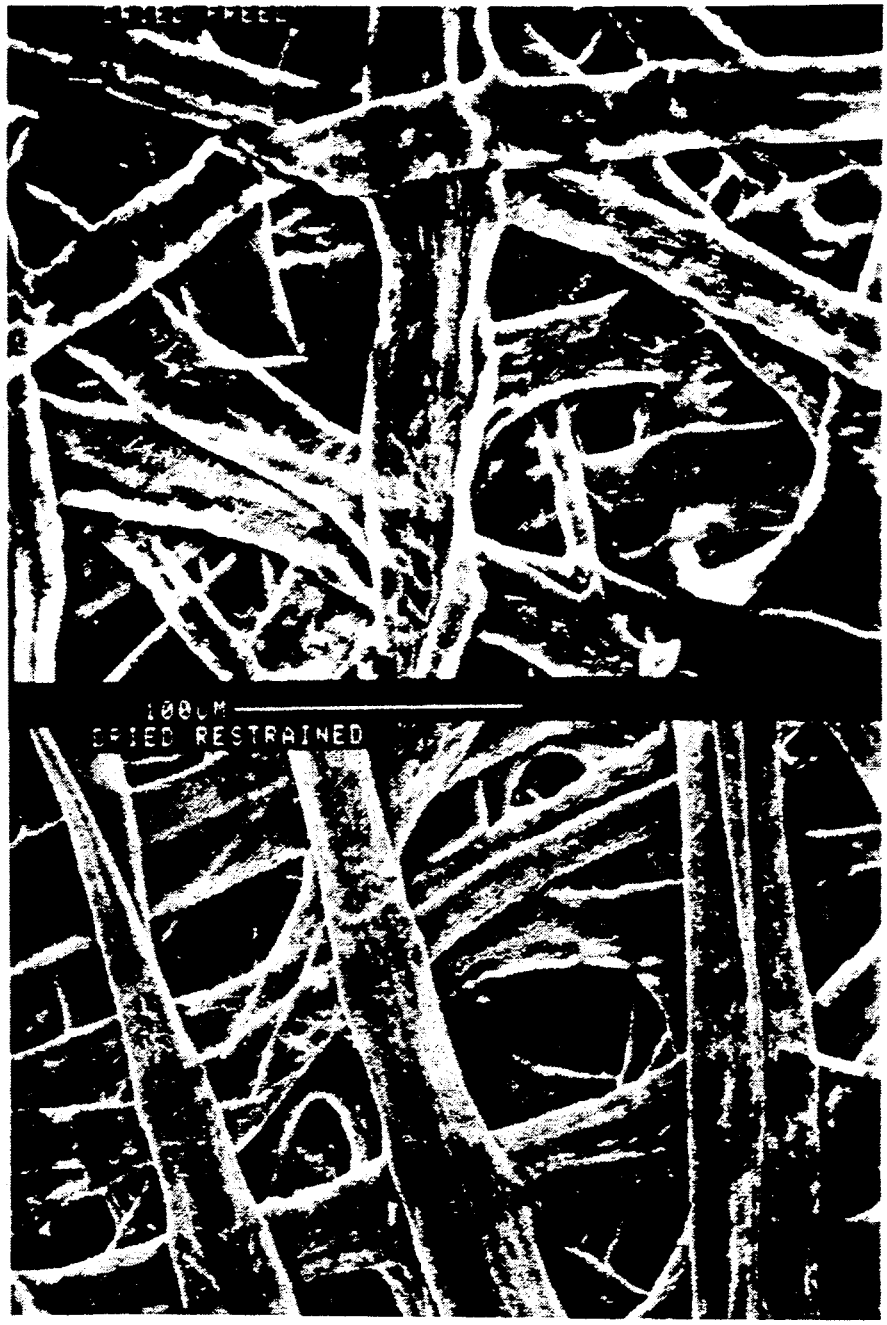
FIG. 18 is a copy of a photomicrograph showing the surface of a freely dried sheet and FIG. 19 is a photomicrograph showing the surface of a restraint dried sheet.

The photomicrographs shown in FIGS. 18 and 19 compare the fiber surface characteristics of a sheet taken from the center of the machine that is under partial cross-machine direction restraint to a sheet taken from the edges with unrestrained cross-machine direction. These micrographs show the same reduction in fiber kinks and caliper as seen in laboratory dried samples.

In summary, the cross-directional sheet shrinkage which occurs during the drying process is highly nonuniform. This nonuniform shrinkage directly affects the cross-machine direction stretch, tensile, modulus and TEA profiles. The greatest shrinkage occurs near the edges. In order to achieve a level basis weight profile at the reel, the headbox slice opening must be reduced near the edges to recompensate for the edge shrinkage. The nonuniform shrinkage thereby indirectly affects fiber orientation and a single tier dryer section with intermediate vacuum rolls can be used to control the cross-machine direction shrinkage. Vacuum levels in the intermediate rolls or guide rolls in the range of 6 to 8 inches WC will continue the restraint applied by the dryer fabric pressure and substantially reduce the edge shrinkage.

This control of shrinkage will produce more uniform cross-direction property profiles, allow the slice opening to remain level, reduce the cross-machine direction variations in fiber orientation and minimize any tendency for curl, cockle or grainy edges to develop. Also, the web is restrained during transfer between drying sections as shown in Ser. No. 014,569 and restraint of the sheet is provided by a vacuum of at least 6" W.C.

What is claimed is:

1. A process for the restrained drying of a paper web extending successively through a wet end and a dry end of a dryer section of papermaking machine, said process comprising the steps of:

moving the paper web and a dryer felt contiguously to each other such that the web and felt wrap a portion of a heated surface of a rotatable dryer such that the web is disposed between the felt and the heated surface so that the web is restrained against cross-machine directional shrinkage;

thereafter immediately guiding the web and felt contiguously relative to each other around a vacuum guide roll disposed downstream relative to the dryer, the arrangement being such that the web is supported by the felt during passage of the web along a minimal felt draw between the dryer and the guide roll, such that the felt is disposed between the web and the guide roll when the web and felt wrap around a portion of the surface of the guide roll;

connecting the guide roll to a source of vacuum of at least 6 inches water column such that a vacuum is applied to the web through the felt when the web and felt wrap around the guide roll so that the web is drawn into close conformity with the felt when the web and felt wrap around the guide roll, the arrangement being such that the web is restrained against cross-machine directional shrinkage during movement of the web around the guide roll; and leading the web and felt contiguously around a further dryer disposed immediately downstream relative to the guide roll, the dryer and further dryer being a portion of a single tier drying section for drying the web during movement of the web downstream relative to the wet end of the dryer section so that cross-machine directional shrinkage of the web particularly during drying of the web in the dry end of the dryer section is inhibited, and so that the edge curl and cockle of the resultant web is minimized.

2. A process as set forth in claim 1 wherein the restrained drying is accomplished when the web has attained a dryness within the range from 40–60 percent dry.

3. A process as set forth in claim 1 wherein the restrained drying of the web is carried out after the web attains a dryness above 60 percent dry.

* * * * *